US005282360A

United States Patent [19]

Hamburg et al.

[11] Patent Number: 5,282,360

[45] Date of Patent: Feb. 1, 1994

[54] POST-CATALYST FEEDBACK CONTROL

[75] Inventors: Douglas R. Hamburg, Bloomfield; Thomas R. Culbertson, Redford; Judith M. Curran, Northville, all of Mich.

[73] Assignee: Ford Motor Company, Dearborn, Mich.

[21] Appl. No.: 968,937

[22] Filed: Oct. 30, 1992

[51] Int. Cl.[5] ..... F02M 7/12; F02B 3/00

[52] U.S. Cl. ..... 60/274; 123/694; 123/696

[58] Field of Search ..... 123/691, 694, 696, 682, 123/695; 60/274, 276

[56] References Cited

U.S. PATENT DOCUMENTS

| | | | |
|---|---|---|---|
| 4,019,474 | 4/1977 | Nishimiya et al. | 123/694 |
| 4,073,269 | 2/1978 | Herth et al. | 123/696 |
| 4,077,364 | 3/1978 | Aoki | 123/682 |
| 4,174,689 | 11/1979 | Hosaka | 123/696 |
| 4,191,151 | 3/1980 | Wanamaker | 123/694 |
| 4,210,106 | 7/1980 | Wessel et al. | 123/696 |
| 4,350,130 | 9/1982 | Shulman | 123/696 |
| 4,385,608 | 5/1983 | Ohgami et al. | 123/682 |
| 4,388,903 | 6/1983 | Yoshida et al. | 123/682 |
| 4,428,345 | 1/1984 | Bertsch et al. | 123/696 |
| 4,462,373 | 7/1984 | Kanno | 123/696 |
| 4,594,984 | 6/1986 | Raff et al. | 123/695 |
| 4,671,244 | 6/1987 | Clement et al. | 123/696 |
| 4,744,344 | 5/1988 | Morozumi | 123/696 |
| 4,779,414 | 10/1988 | Nagai et al. | 123/691 |
| 4,825,837 | 5/1989 | Nakagawa | 123/696 |
| 4,853,862 | 8/1989 | Shiraishi et al. | 123/696 |
| 4,878,472 | 11/1989 | Hibino | 123/696 |
| 4,926,826 | 5/1990 | Nakaniwa et al. | 123/696 |
| 5,069,035 | 12/1991 | Kayanuma | 60/274 |
| 5,094,208 | 3/1992 | Adam et al. | 123/696 |
| 5,099,818 | 3/1992 | Takahashi et al. | 123/696 |
| 5,168,700 | 12/1992 | Furuya | 123/274 |

*Primary Examiner*—E. Rollins Cross
*Assistant Examiner*—Thomas N. Moulis
*Attorney, Agent, or Firm*—Peter Abolins; Roger L. May

[57] ABSTRACT

An exhaust gas oxygen sensor is used to control the air/fuel ratio of an internal combustion engine in combination with an electronic engine control. The exhaust gas oxygen sensor is positioned in the exhaust stream flow from the engine. The electronic engine control utilizes different air/fuel ratio feedback strategies depending upon whether the signal output from the exhaust gas oxygen sensor is saturated indicating a rich air/fuel ratio, saturated indicating a lean air/fuel ratio or operating in a linear region.

12 Claims, 4 Drawing Sheets

1V
Post-Cat.
EGO Sensor
Volts
0V
100 SEC
Time

POST-CATALYST FEEDBACK CONTROL

BACKGROUND OF THE INVENTION

1. Field of the Invention

This invention relates to electronic engine control of internal combustion engines.

2. Prior Art it is known to control the air/fuel ratio (A/F) of internal combustion engines using exhaust gas oxygen sensors positioned in the exhaust stream from the engine and an electronic control module coupled to the exhaust gas sensor. Because of the response time of this system and such components as catalysts in the exhaust gas stream, there are occasions when erratic low frequency oscillations occur with feedback from EGO sensors placed after the catalyst. It would be desirable to eliminate such erratic low frequency oscillations.

It is known to have A/F feedback systems for engines with exhaust gas oxygen (EGO) sensors placed behind the catalyst in an effort to achieve more precise A/F control with respect to the catalyst window. The rationale for this action is illustrated in FIG. 1A and 1B which show catalyst conversion efficiency and EGO sensor output voltage versus A/F irrespectively for sensors located both in front of and behind a typical catalyst. As this figure indicates, the switch point of the precatalyst EGO sensor does not coincide exactly with the catalyst window, whereas the switch point of the post-catalyst sensor generally does.

Unfortunately, closed-loop A/F control systems using feedback from a post-catalyst EGO sensor frequently display erratic low-frequency oscillations under certain operating conditions. Two examples of this are illustrated in FIGS. 2A and 2B which show plots of post-catalyst EGO sensor output voltage versus time obtained when the engine was operated under closed-loop A/F control using conventional low-gain integral feedback from the post-catalyst EGO sensor. In FIG. 2A, the EGO sensor output voltage shows an erratic low-frequency oscillation of approximately 0.024 Hertz, while in FIG. 2B, the sensor output voltage shows a well-defined oscillation of approximately 0.015 Hertz. Such low-frequency oscillations are somewhat unpredictable, and occur with certain combinations of catalysts and EGO sensors, but not with all. These low-frequency oscillations are undesirable both from an emissions standpoint (because they produce a loss of catalyst conversion efficiency) and from a catalyst monitoring standpoint (because they can cause erroneous indications from the catalyst monitoring system). These are some of the problems this invention overcomes.

SUMMARY OF THE INVENTION

A structure in accordance with an embodiment of this invention prevents low-frequency oscillations, such as described above, from occurring with post-catalyst A/F feedback systems. The invention includes operation by selecting one of three different feedback signals based on the magnitude of the post-catalyst EGO sensor output voltage.

When the EGO sensor output voltage indicates a rich condition ($V_{out}>0.7$ volts, for example), the feedback signal would be a linear ramp which slowly leans out the engine A/F as a function of time. When the EGO sensor output voltage indicates a lean condition ($V_{out}<0.15$ volts, for example), the feedback signal would be a linear ramp which slowly enriches the engine A/F as a function of time. When the EGO sensor voltage is between the rich and lean limits, the feedback signal would be proportional to the difference between the output of the EGO sensor and an appropriate reference voltage such as 0.45 volts.

In addition, in an effort to reduce steady-state offset errors, it may be advantageous to include a small amount of integral feedback along with the proportional feedback when the EGO sensor is between the rich and lean limits. In some applications, it may be desirable to freeze the feedback signal when the EGO sensor is between the rich and lean limits, thereby producing a dead band.

DETAILED DESCRIPTION OF THE INVENTION

Figure 1A:
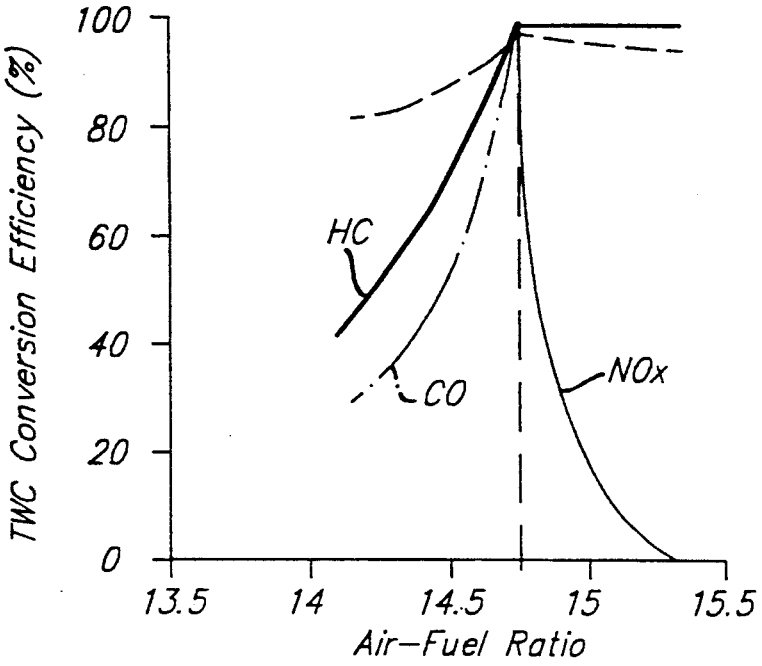
FIGS. 1A and 1B are graphic representations of the three way catalyst conversion efficiency and the exhaust gas oxygen sensor output voltage versus air/fuel ratio, respectively.
Figure 1B:
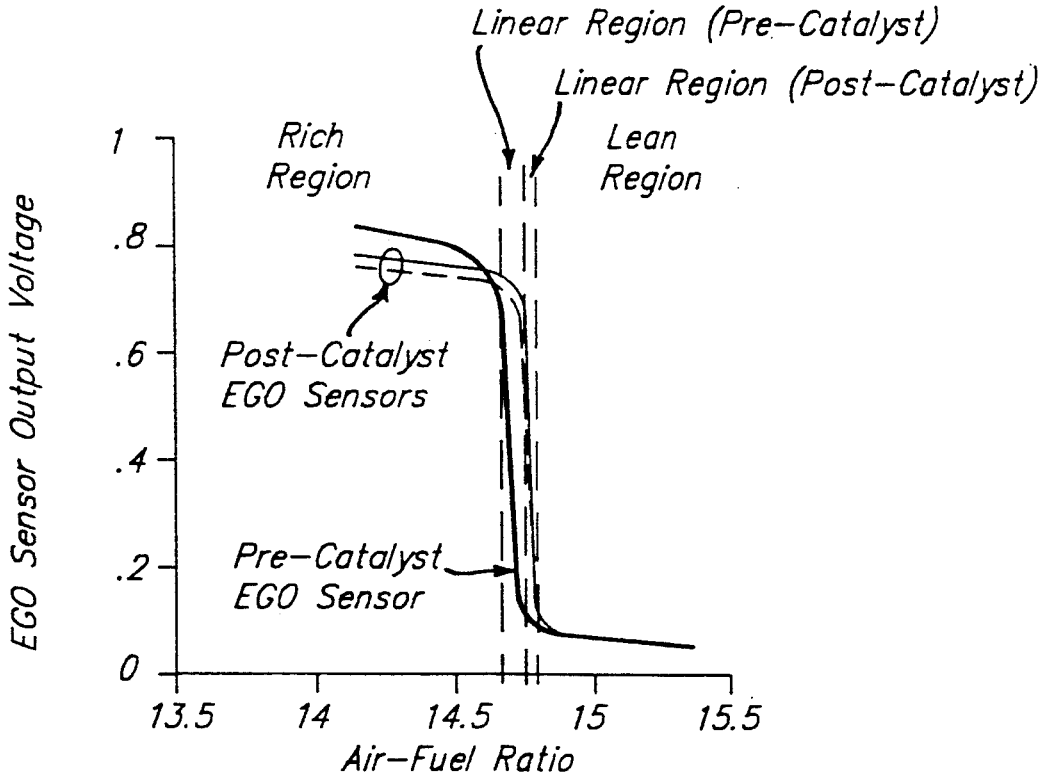

When an internal combustion engine is operating on the rich side of a catalyst window (i.e., rich of stoichiometry as indicated by a post-catalyst EGO sensor), the output of the EGO sensor is essentially saturated at a "high" output voltage and does not give any meaningful information as to how much the engine A/F is rich of stoichiometry (See FIGS. 1A and 1B). The feedback strategy in this case is to simply ramp the engine A/F back toward stoichiometry until the sensor output voltage starts to switch toward its lean state. Since the catalyst presents an appreciable time delay to the exhaust gases which pass through it, the rate at which the feedback signal commands the engine A/F toward stoichiometry must be restricted to a very low value. This is necessary so that the A/F won't pass through stoichiometry faster than the EGO sensor can detect and subsequently hold it in the window of the catalyst.

For example, if the non-saturated (or linear) region of the EGO sensor characteristic is 0.05 A/F wide, and the time delay through the engine and catalyst is 10 seconds, the maximum A/F ramp rate would be $0.05/10=0.005$ A/F per second. This value will insure that once the A/F enters the sensor's non-saturating region, the sensor will be able to initiate a change in the A/F and subsequently detect the effect of the change before the A/F has caused the sensor voltage to reach its other saturated level. The A/F ramp rate can be automatically adjusted to provide the fastest possible feedback correction without causing unstable system operation. This automatic rate control could be implemented by periodically increasing the A/F ramp rate until the system begins to oscillate in a well defined limit-cycle, and then reducing the ramp rate by an appropriate amount. In precatalyst applications of the invention, the time delay through the engine will be a function of rpm (and torque). The optimum value for the ramp rate will therefore be a function of engine rpm (and torque), and will be contained in an appropriate table in the engine control computer.

Now when the engine is operating at an A/F which is in the catalyst window (i.e., in the non-saturated region of the EGO sensor characteristic), the output voltage of the EGO sensor will be approximately linearly related to A/F as suggested by the post-catalyst EGO sensor plot shown in FIG. 1B. Since the EGO sensor output voltage in this case does provide information as to how far the engine A/F is away from stoichiometry, the strategy is to feed back a signal that is proportional to the difference between the output of the EGO sensor and a suitable reference voltage such as 0.45 volts. Since the catalyst will exhibit an appreciable amount of time delay irrespective of the feedback mode, the value of the proportional feedback gain must be kept to a low value so that the feedback system will not become unstable and oscillate. The gain should be high enough to correct possible A/F disturbances as fast as possible without causing oscillations. In some applications where the need to provide oscillations is paramount, the gain might be reduced to zero so that the linear region effectively becomes a dead band.

It may be desirable to add a small amount of integral feedback to the proportional feedback signal in this "linear" operating region in order to eliminate any steady-state A/F offsets that may arise. The value of the gain used for this integral feedback would be chosen to be sufficiently high to eliminate steady-state errors, but not too high to cause unstable (i.e., oscillatory) operation. Further, it may be advantageous to "truncate" the lower end of the linear region of the EGO sensor output voltage by raising the lean switch voltage (from 0.15 volts to 0.5 volts, for example,) and also increasing the reference voltage (from 0.45 volts to 0.6 volts, for example). The reason for this is to provide a slightly rich shift in the effective linear operating range of the EGO sensor in order to enhance the ability of the A/F feedback control system to provide optimum catalyst conversion efficiency. Some engine/dynamometer studies have shown that the highest simultaneous conversion efficiency for HC, CO, and NOx occurs when the post-catalyst sensor control voltage is approximately 0.6 volts. The actual control voltage is a function of the operating temperature of the EGO sensor.

When the engine is operating on the lean side of the catalyst window (i.e., lean of stoichiometry as indicated by the post-catalyst EGO sensor), the output of the EGO sensor is essentially saturated at a low output voltage and does not give any meaningful information as to how much the engine A/F is lean of stoichiometry (See FIG. 1B). The feedback strategy in this case is to simply ramp the engine A/F back toward stoichiometry until the sensor output voltage starts to switch toward its rich state. This is the same strategy that was used when the engine was operating on the rich side of the catalyst window except now the engine A/F is ramped rich rather than lean.

As previously discussed, the rate at which the feedback signal ramps the engine A/F toward stoichiometry must be restricted to a very low value so that the A/F won't pass through stoichiometry faster than the EGO sensor can detect and subsequently hold it in the window of the catalyst. Also, as previously discussed, the ramp rate of the A/F feedback signal could be automatically adjusted to provide the fastest possible feedback correction without causing system oscillation. In precatalyst applications of the invention, the optimal ramp rate will be a function of engine rpm (and torque), and will be contained in an appropriate table in the engine control computer.

Figures 2A, 2B, 3A, 3B:
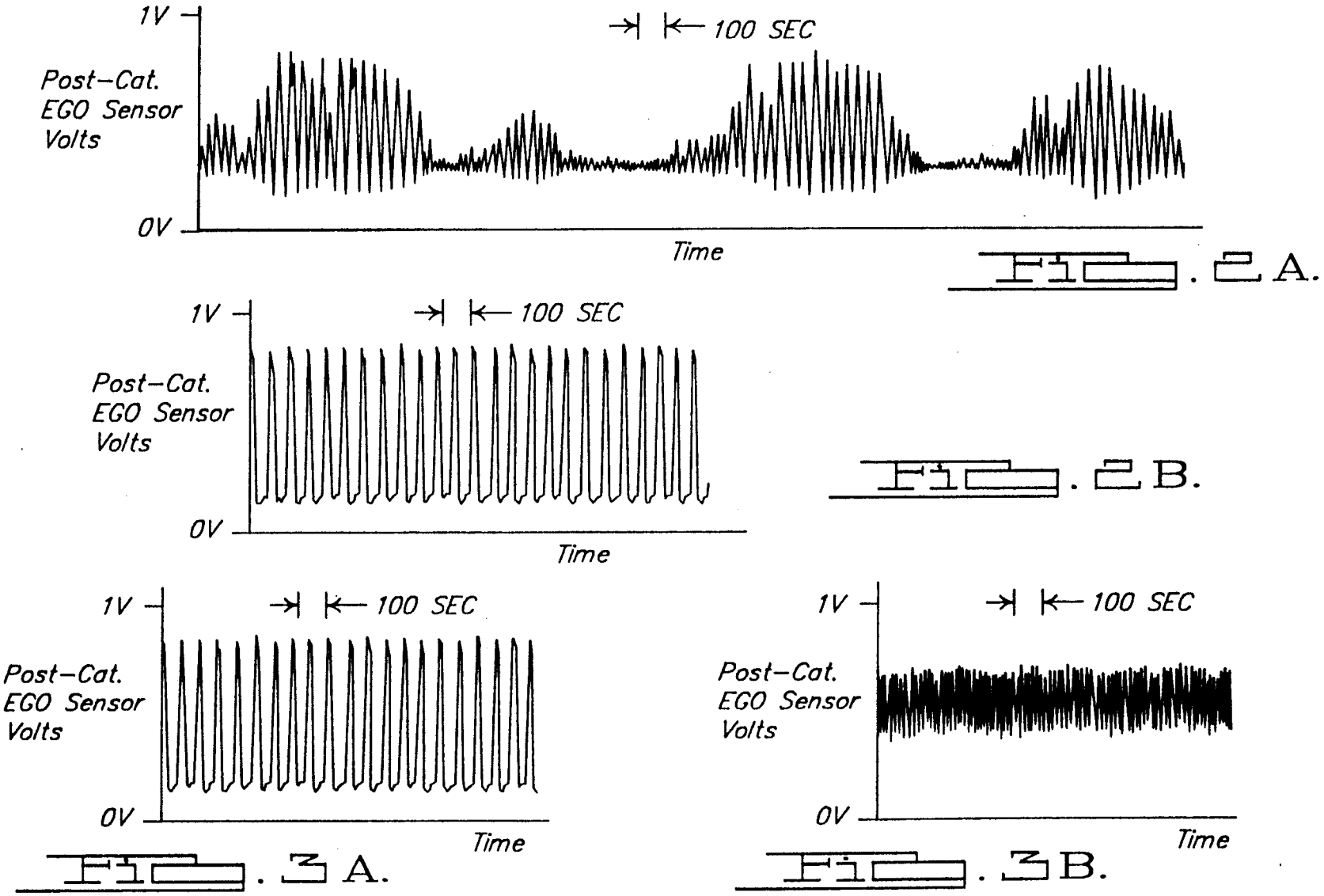
FIGS. 2A and 2B are plots of post catalyst exhaust gas oxygen sensor voltage versus air/fuel ratio, on a time line.
FIGS. 3A and 3B are graphic representations of post catalyst exhaust gas oxygen sensor voltage versus air/fuel ratio for pure integral controller and a tristate feedback controller, respectively.

A tristate control method, in accordance with an embodiment of this invention, can be applied to a system with precatalyst and post-catalyst A/F feedback to eliminate erratic oscillations. An example of the invention's ability to eliminate low-frequency oscillations is presented in FIGS. 3A and 3B which show the post-catalyst EGO sensor output voltages versus time for a pure integral post-catalyst A/F feedback controller (FIG. 3A) and for this tristate controller (FIG. 3B). As the figures indicate, the low-frequency oscillation that occurs with the pure integral feedback is eliminated when tristate feedback is used. An embodiment of this invention can also be used to enhance the operation of certain catalyst monitoring schemes. For example, the tristate A/F post-catalyst feedback system can be used to enhance the catalyst monitoring scheme by providing a more uniform A/F versus time characteristic.

Figure 4:
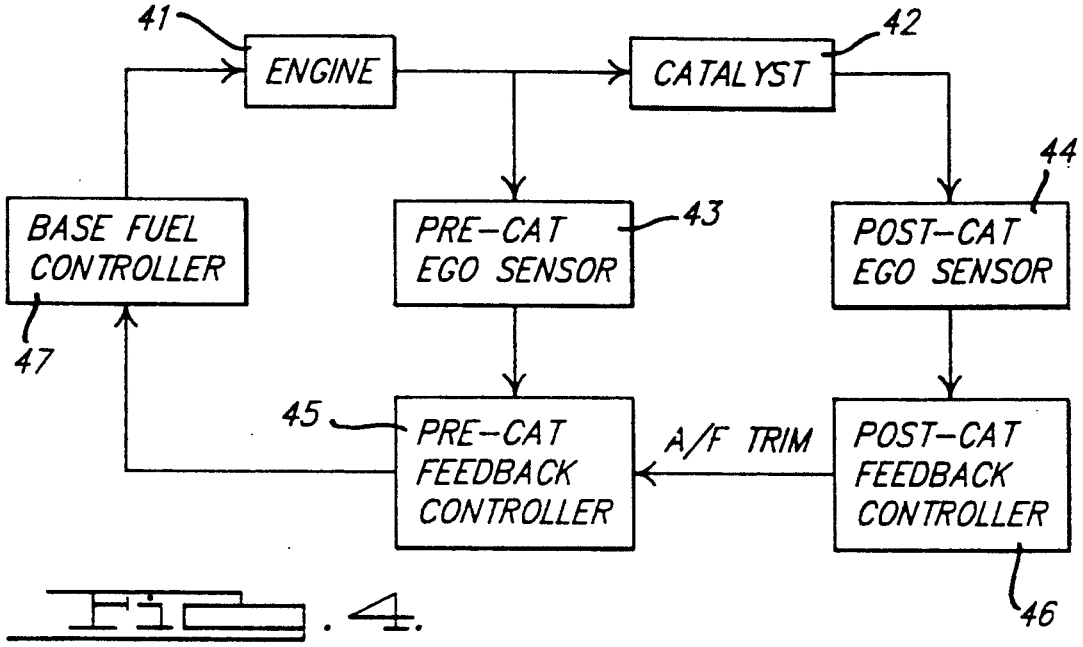
FIG. 4 is a block diagram of a feedback system in accordance with an embodiment of this invention.

Referring to FIG. 4, an engine 41 has an exhaust stream coupled to a catalyst 42. A precatalyst EGO sensor 43 is positioned upstream of catalyst 42 and a post-catalyst EGO sensor 44 is positioned downstream of catalyst 42. A post feedback controller 46 receives a signal from sensor 44 and provides an air/fuel ratio trim signal to a precatalyst feedback controller 45 which also receives a signal from sensor 43. The output of feedback controller 45 is applied to a base fuel controller 47 which provides a fuel control signal to engine 41.

As shown in FIG. 4, a post-catalyst tristate A/F controller can be combined with a precatalyst A/F controller in order to realize the high-frequency correction capabilities of the precatalyst feedback loop. Post-catalyst A/F feedback controller 46 serves as a trim for precatalyst A/F feedback controller 45. The A/F trim will maintain post-catalyst EGO sensor 44 at stoichiometry by appropriately changing the "dc" value of the precatalyst feedback loop. It should be noted that the actual A/F trim can be accomplished in one of several different ways. For example, the feedback signal from post-catalyst A/F controller 46 can be used to change the switch point of precatalyst EGO sensor 43. Alternately, the feedback signal from post-catalyst controller 46 can be used to change -the relative values of the up-down integration rates and/or the jump back in precatalyst controller 45.

The tristate control method can be applied to the control of any A/F feedback loop utilizing an EGO sensor. As such, it can be directly applied to the precatalyst feedback loop as well as the post-catalyst feedback loop. Using tri-state control in the precatalyst feedback loop can eliminate the limit-cycle mode of operation normally associated with the precatalyst feedback loop.

To explain in more detail how the invention would work, consider the rich, linear and lean regions shown in FIG. 1B. Furthermore, referring to FIG. 5, assume that the engine A/F is initially rich of stoichiometry and that the A/F feedback loop is closed at $t=t_1$. Since the EGO sensor would initially see a rich A/F, its output would be approximately equal to 0.8 volts, and the A/F feedback controller would therefore slowly ramp the A/F leaner. When the engine A/F reached the linear region of the EGO sensor, the feedback controller would switch from a simple ramping mode to a proportional (or proportional plus integral) feedback mode. When this occurs (at $t= t_2$), the controller would drive the engine A/F to a pre -programmed setpoint (for example, 14.7). Assuming there were no other changes, the engine A/F would remain at this point. Idealized waveforms of the engine A/F, the EGO sensor output, and the feedback control signal corresponding to this example are shown in FIGS. 5A, 5B, and 5C as a function of time.

If the engine A/F were initially lean of stoichiometry rather than rich, the EGO sensor would initially see a lean A/F, and its output would be approximately equal to 0.1 volts. In this case, when the A/F feedback loop is closed, the A/F feedback controller would slowly ramp the A/F richer until the engine A/F reached the linear region of the EGO sensor. At that time, the feedback controller would switch from a simple ramping mode to a proportional (or proportional plus integral) feedback mode, and the controller would drive the engine A/F to the pre-programmed setpoint. Assuming there would no other changes, the engine A/F would remain at this point. Idealized waveforms of the engine A/F, the EGO sensor output, and the feedback control signal corresponding to this situation are shown in FIGS. 6A, 6B, 6C as a function of time.

Figure 5:
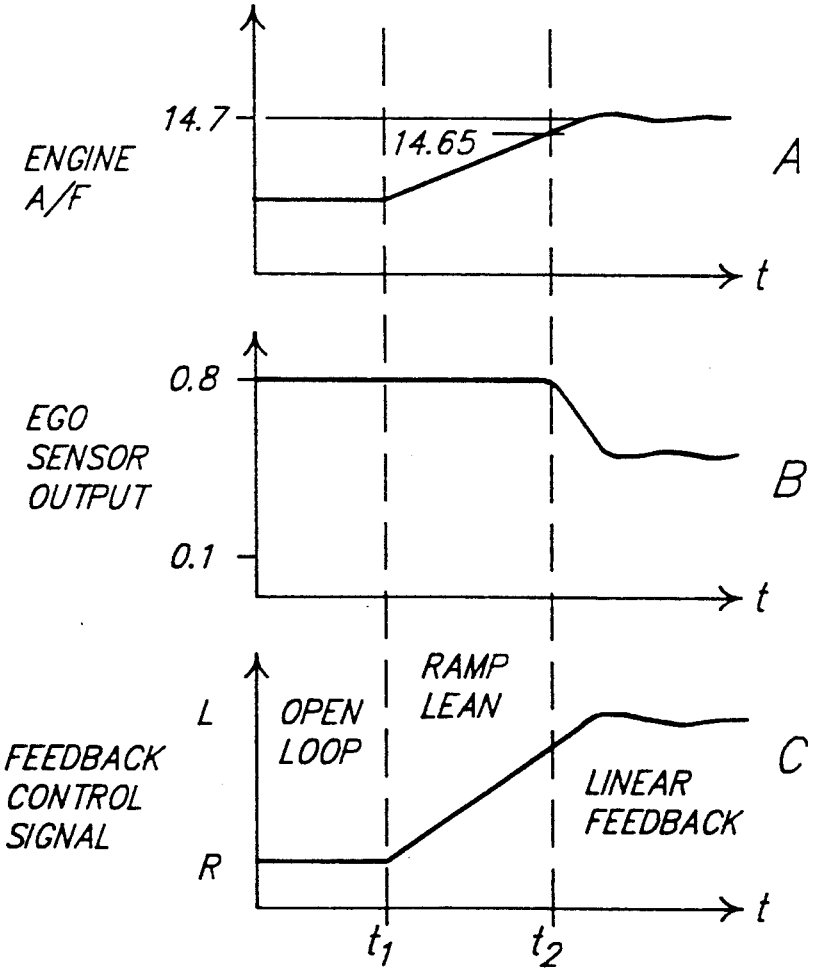
FIGS. 5A, 5B, and 5C are graphical representations of engine air/fuel ratio, EGO sensor output, and feedback control signal with respect to time, in accordance with an embodiment of this invention.
Figure 6:
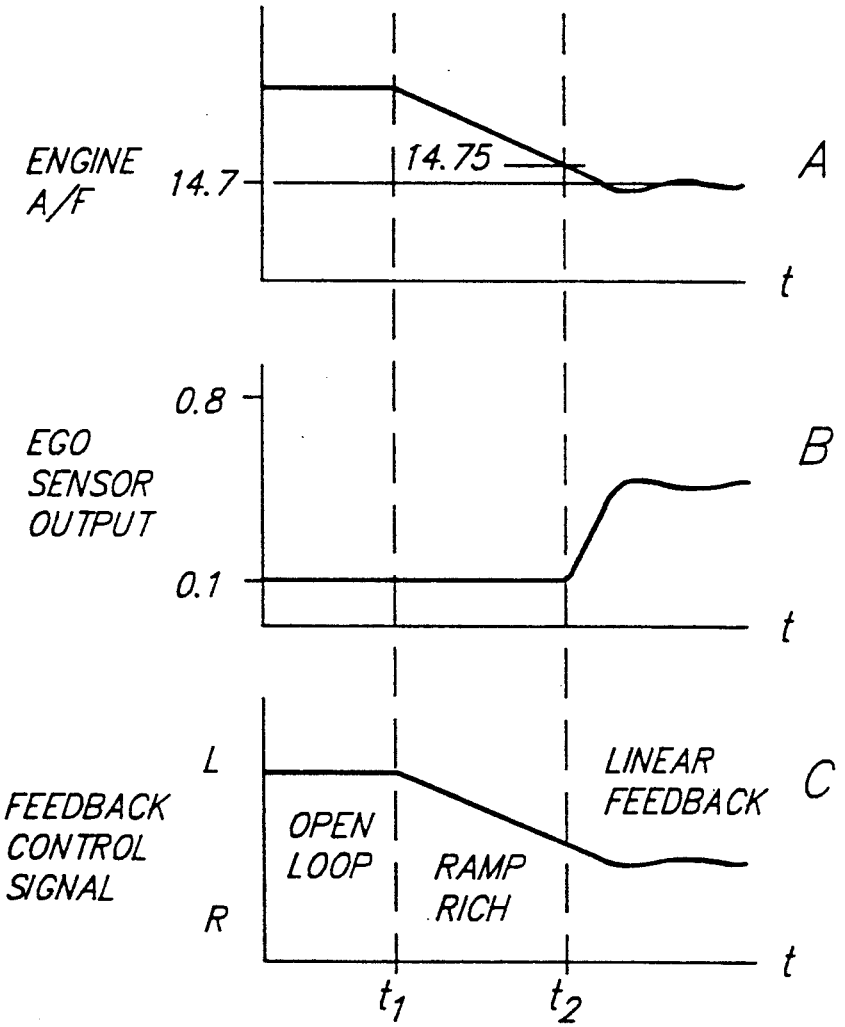
FIGS. 6A, 6B, and 6C are graphical representations of engine air/fuel ratio, EGO sensor output, and feedback control signal with respect to time, in accordance with an embodiment of this invention.

It should be noted that the time scales in FIGS. 5 and 6 are not defined. This is because the actual times depend on whether the feedback system is pre-catalyst or post-catalyst, and the invention will apply to both situations. For clarity, no signal noise is shown on the various traces in FIGS. 5 and 6.

What is claimed:

1. A method for controlling air/fuel ratio of an internal combustion engine controlled by an electronic engine control and having an exhaust gas oxygen (EGO) sensor positioned in an exhaust stream flow from the engine, said method including the step of utilizing different air/fuel ratio feedback control strategies depending upon whether the exhaust gas oxygen sensor is saturated, rich or lean, or operating in a linear region.

2. A method as recited in claim 1, further including the step of utilizing a linearly ramping lean feedback signal, when exhaust gas oxygen output sensor voltage indicates a rich condition, so as to lean out the engine air/fuel ratio as a function of time.

3. A method as recited in claim 2 further comprising the step of utilizing a linearly ramping rich feedback signal, when the exhaust gas oxygen sensor output indicates a lean condition, so as to enrich the engine air/fuel ratio as a function of time.

4. A method as recited in claim 3 further comprising the step of utilizing a feedback signal which is a function of the difference between the output of the EGO sensor and an appropriate reference voltage, when the exhaust gas oxygen sensor voltage is between rich and lean saturation limits.

5. A method as recited in claim 4 wherein said function of the difference is a proportional function.

6. A method as recited in claim 4 wherein said function of the difference is a proportional function plus an integral function.

7. A method as recited in claim 3 further comprising the step of making the feedback signal to be invariant so that a feedback dead band results, when the exhaust gas oxygen sensor voltage is between the rich and lean saturation limits.

8. A method as recited in claim 1 further including the steps of:

providing a catalyst in the engine exhaust stream;

providing an upstream exhaust gas oxygen sensor positioned upstream of the catalyst; and utilizing an output from the upstream exhaust gas oxygen sensor as an input to the air/fuel ratio feedback control strategy.

9. A method as recited in claim 1 further including the steps of:

providing a catalyst in the engine exhaust stream;

providing a downstream exhaust gas oxygen sensor positioned downstream of the catalyst; and utilizing an output from the downstream exhaust gas oxygen sensor as an input to the air/fuel ratio feedback control strategy.

10. A method as recited in claim 1 further including the steps of:

providing a catalyst in the engine exhaust stream;

providing a downstream exhaust gas oxygen sensor positioned downstream of the catalyst;

providing an upstream exhaust gas oxygen sensor positioned upstream of the catalyst; and utilizing outputs from both the upstream and the downstream exhaust gas oxygen sensors as inputs to the air/fuel ratio feedback control strategy.

11. A method as recited in claim 2 further including a step of determining a lean ramp rate by increasing the ramp rate until a limit-cycle oscillation results and then reducing the ramp rate.

12. A method as recited in claim 3 further including a step of determining a rich ramp rate by increasing said ramp rate until a limit-cycle oscillation results, and then reducing the ramp rate by a suitable amount.

* * * * *